US005335971A

United States Patent [19]

Kelley

[11] Patent Number: 5,335,971

[45] Date of Patent: Aug. 9, 1994

[54] FOLDABLE CHAIR

[75] Inventor: James O. Kelley, Spring Lake, Mich.

[73] Assignee: Sligh Furniture Co., Holland, Mich.

[21] Appl. No.: 961,405

[22] Filed: Oct. 15, 1992

[51] Int. Cl.[5] ..... A47C 4/00

[52] U.S. Cl. ..... 297/378.12; 297/378.1

[58] Field of Search ..... 297/379, 378, 34, 16, 297/29, 291-293, 380, 354, 444-446

[56] References Cited

U.S. PATENT DOCUMENTS

| | | | |
|---|---|---|---|
| 446,249 | 2/1891 | Craig | 297/380 X |
| 1,683,532 | 9/1928 | Derwish | 297/34 |
| 2,127,398 | 8/1938 | Freeman | 297/378 X |
| 2,604,144 | 7/1952 | Celizic | 297/378 X |
| 2,646,839 | 7/1953 | Hillman | 297/379 X |
| 3,140,896 | 7/1964 | Babbs | 297/378 X |
| 4,059,305 | 11/1977 | Ammirata | 297/338 |
| 4,186,959 | 2/1980 | Thebaud | 297/16 |
| 4,971,395 | 11/1990 | Coussemacq et al. | 297/378 |
| 5,069,503 | 12/1991 | Martinez | 297/379 X |

FOREIGN PATENT DOCUMENTS

| | | | |
|---|---|---|---|
| 0622794 | 5/1949 | United Kingdom | 297/354 |

*Primary Examiner*—Kenneth J. Dorner
*Assistant Examiner*—Milton Nelson, Jr.
*Attorney, Agent, or Firm*—Waters & Morse

[57] ABSTRACT

A foldable chair contains a back support for supporting a person in a seating position. The chair has a seating structure with two front legs for providing vertical support to the seating structure, a seat connected to the top of each of the two legs, and two rear legs positioned respectively behind each of the two front legs. The rear legs extend above the seat and are also connected to the seat. A pivot rod is connected to each of the two rear legs above the seat for pivotally supporting the back support. The back support has a back cushion support containing a pivot rod hole configured to fit around the pivot rod. The back cushion support in turn connects to a back cushion. An upright holding mechanism connects to a lower end of the back cushion support and is configured to releasable hold the back cushion support in a vertical position. The back cushion is connected to an upper end of the back cushion support for rearwardly supporting the person in the seating position.

12 Claims, 2 Drawing Sheets

FOLDABLE CHAIR

BACKGROUND OF THE INVENTION

This invention relates to a chair having a foldable back to reduce its vertical height. More particularly, this invention relates to a chair with a back support pivotable along a pivot rod which is attached to the rear legs of the chair. The back support folds down into contact with the seating support such that the chair may be positioned underneath another structure such as a standard table.

Due to an increase in expenses for office space, greater demands for efficient space utilization have been placed on businesses. Desks are being moved closer together and walkways between desks are becoming narrower. Accordingly, there is an increased need for a comfortable and efficient chair which will withstand the rigors of continual use and also fold easily for temporary storage underneath a desk or table.

In the home, it is becoming quite common to replace the traditional den with a work station near the kitchen and dining area. This work station provides a convenient place for the family to assemble their finances, post messages, and place a phone call, while also providing a readily accessible writing surface. These work station are frequently built into the kitchen counter top with an open space or knee hole left underneath the counter to facilitate seating. Space is generally at a premium in such locations and a traditional desk chair often gets in the way. Thus, there is an increased need for a decorative and comfortable chair which will fit out of the way underneath this work station when not in use. Additionally, such a seating structure is also needed in hotel and motel rooms for efficient space utilization.

It is an object of the present invention to provide a foldable chair which is comfortable and will withstand daily continual use. It is another object of this invention to provide a chair with a rigid back support which may be folded so that the entire chair may be temporarily stored underneath the knee hole of a desk or table. It is still another object of the invention to provide a means for removably locking the back support in an upright position when the chair is in use. The present invention is an improvement over prior chair designs employing folding backs.

SUMMARY OF THE INVENTION

A foldable seating structure contains a back support for supporting a person in a seating position. The seating structure has two front legs for providing vertical support to the seating structure, a seat connected to the top of each of the two legs, and two rear legs positioned respectively behind each of the two front legs. The rear legs extend above the seat and are also connected to the seat. A pivot rod is connected to each of the two rear legs above the seat for pivotally supporting the back support. A back cushion support containing an opening that fits over the pivot rod supports the back cushion. An upright holding means connected to a lower end of the back cushion support removably engages the seating support to resiliently hold the back cushion support in a vertical position. A back cushion is connected to an upper end of the back cushion support for rearwardly supporting the person in the seating position.

DETAILED DESCRIPTION OF THE PREFERRED EMBODIMENT

Figure 1:
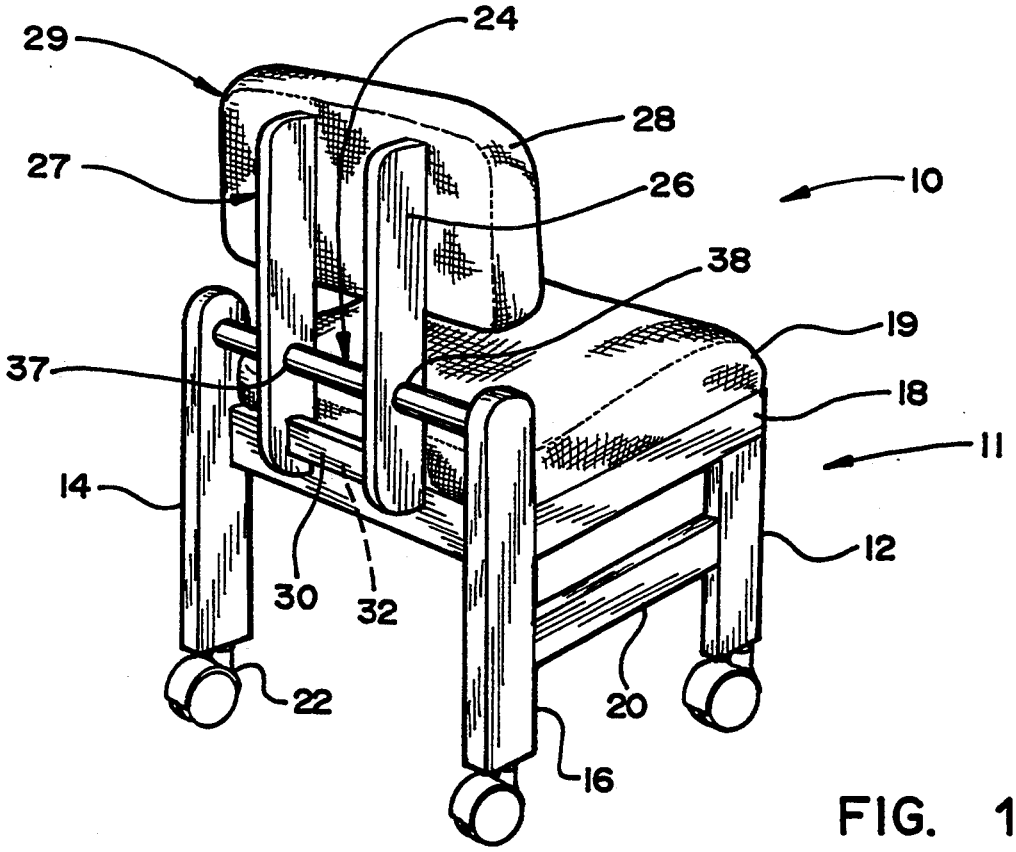
FIG. 1 is a perspective view of a foldable chair showing the back support mounted on a pivot rod.

Referring to the drawings and more particularly to FIG. 1, a foldable chair 10 is disclosed for comfortably seating an individual at a desk or a table. The foldable chair comprises a base 11 and a folding back 29. Base 11 comprises a seat mounted on two seat front vertical members or legs 12 and two seat back vertical members 14 and 16. All four vertical members are mounted to a seating support frame 18. Seat cushion 19 is mounted on top of seating support frame 18 to provide a cushioned surface on which a person may sit. The two seat back vertical members 14 and 16 extend above seating support frame 18. Each seat back vertical member is additionally connected to a corresponding seat front vertical member by a horizontal support member 20. This horizontal support member provides extra strength to the vertical members during rigorous daily use. Casters 22 are desirably mounted underneath the vertical support members to aid in the mobility of the foldable chair. These casters may be made of brass, stainless steel, plastic or other suitable material.

A pivot rod 24 extends between seat back vertical members 14 and 16. Pivot rod 24 is preferably a one inch wood dowel made from birch or maple wood. Each seat back vertical member 14 and 16 contains an inwardly facing blind hole into which pivot rod 24 is configured to fit. Each inwardly facing hole is not visible from an exterior of the foldable chair.

Figure 3:
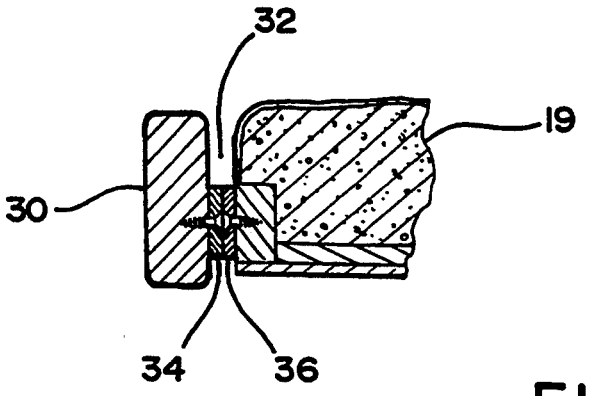
FIG. 3 is a cross sectional of the back cross member and the upright holding means.

The pivot rod 24 is snapped into the openings in seat back vertical members 14 and 16 after the seat frame and vertical members have been assembled and after pivot rod 24 has been inserted through pivot rod holes 37 and 38 of back cushion supports 27 and 26. Each back cushion support 27 and 26 is an elongated flat member containing a pivot rod hole between the ends thereof into which the pivot rod 24 is inserted. Each back cushion support is firmly secured near the top to back cushion 28. A back cross member 30 is connected between the back cushion supports at the lower end to provide additional support. As shown in FIG. 3, back cross member 30 is used to secure back cushion supports 27 and 26 in their vertical positions by means of upright holding mechanism 32. With back cushion 28 and cross member 30 securely in place, the entire seat back 29 can be pivoted on pivot rod 10 between a substantially vertical position during normal use and a substantially horizontal position during temporary storage.

Figure 2:
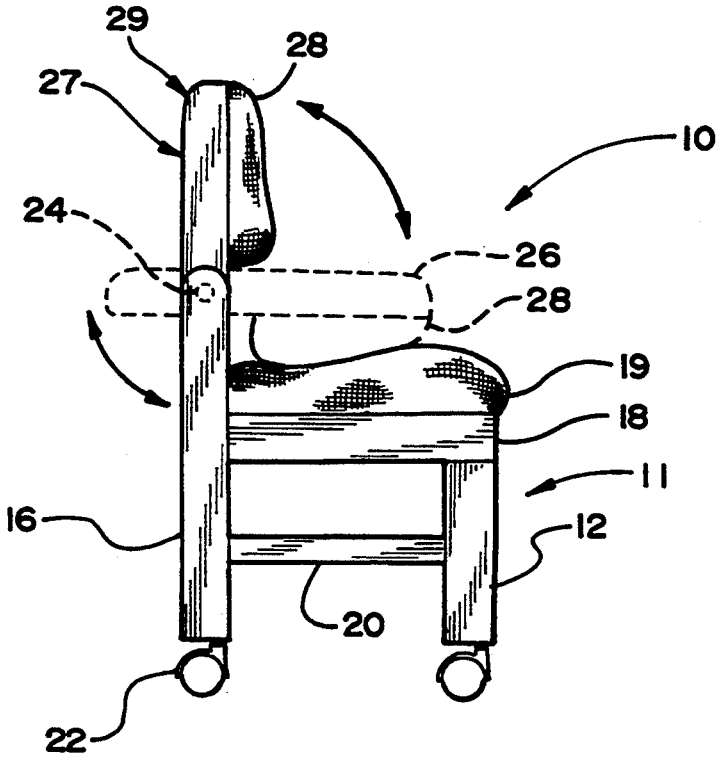
FIG. 2 is a side view of the foldable chair showing the movement of the back support.

Referring to FIG. 2, a side view of the folding chair is shown. Seat back 29 is shown pivotally mounted on pivot rod 24. While in the horizontal position (shown in phantom), back cushion 28 contacts seating support cushion 19. Back cross member 30 extends rearwardly from seat back vertical members 14 and 16. In this configuration, back cross member 30 is easily graspable as a handle by a person. This is especially useful in the case where the foldable chair is positioned under a desk or a table. Thus, the person does not have to bend over and may easily retrieve the foldable chair from its place of temporary storage. Casters 22 also facilitate easy removal from underneath a desk or table by reducing the amount of force required to slide the foldable chair along a floor surface.

The upright holding mechanism 32, which is shown in FIG. 3, comprises movable fastener 34 mounted on back cross member 30 and a mating stationary fastener 36 connected to a seat frame 18 for support cushion 19. Movable fastener 34 and stationary fastener 36 are preferably identical releasable fasteners, such as "Dual Lock Reclosable Fasteners" model number SJ 3463 Type 400 (21 mm diameter) or model number SJ 3465 Type 400 (14 mm diameter) manufactured by 3M. Greater closure strength and adjustability can be obtained when SJ 3463 and SJ 3465 are engaged to a mating fastener with a larger functional surface area. The 3M products are made from 100% polyolefin. The fasteners resiliently lock together to hold the back upright when brought in contact with each other (much like a hook and loop fastener) but can easily be disengaged by forcing the back forwardly to its folded position.

Figure 4:
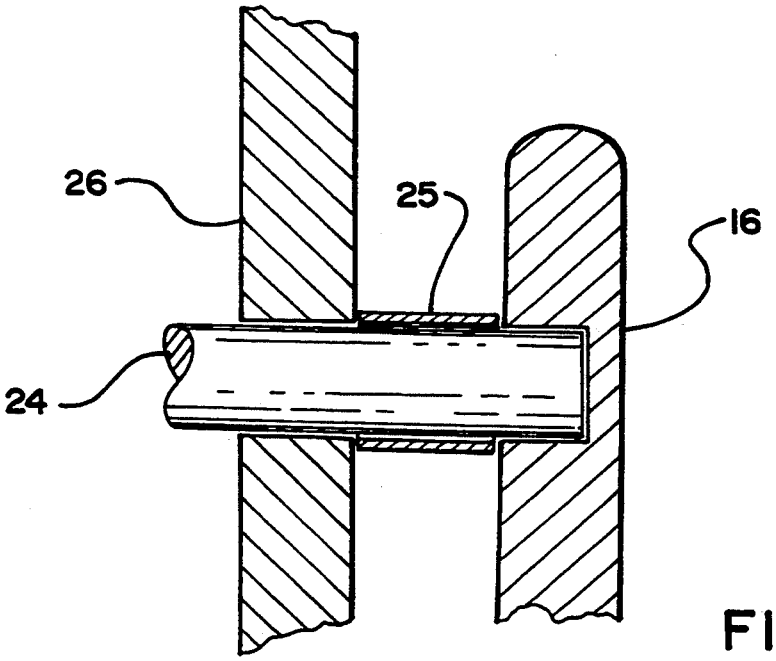
FIG. 4 is a fragmentary rear sectional view of the pivot rod connected through a back cushion support and into a the seat back vertical member.

FIG. 4 shows a rear sectional view of the pivot rod 24 connected through a back cushion support 26 and into a the seat back vertical member 16. Spacer 25 is shown disposed between back cushion support 26 and seat back vertical member 16. Another spacer, not shown, is disposed between back cushion support 27 and seat back vertical member 14. Together, both spacers prohibit lateral movement of the back support 29 along pivot rod 24. Thus, the back support 29 is always correctly positioned to receive a person seated on seating cushion 19. The spacer 25 may be made from a polyurethane tube with a one inch diameter. The spacer may be clear or in a decorative wood color to provide beauty to the foldable chair.

It should be understood that the foregoing is merely exemplary of the preferred practice of the present invention and that various changes may be made in the arrangements and details of construction of the embodiments disclosed herein without departing from the spirit and scope of the present invention, which is defined in the appended claims.

I claim:

1. A foldable chair containing a back support for supporting a person in a seating position comprising:

a seat;

two seat front vertical support members attached to a front side of the seat and providing vertical support to the seat;

two seat back vertical support members positioned respectively behind each of the two seat front vertical support members, the seat back vertical support members being connected to a rear side of the seat and providing vertical support to the seat, the seat back vertical support members extending upwardly above the seat;

a pivot rod supported between the two seat back vertical support members above the seat;

a back cushion support mounted on the pivot rod between the seat back vertical support members and being pivotable about the axis of the pivot rod, the pivot rod extending through the back cushion support at a position between upper and lower ends thereof, the lower end of the back cushion support being positioned opposite the rear side of the seat when the back cushion support is in an upright position;

upright holding means connected to the lower end of the back cushion support and the seat for releasably holding the back cushion support in an upright position; and a back cushion connected to the upper end of the back cushion support for rearwardly supporting the person in the seating position.

2. The foldable chair according to claim 1 wherein the back cushion support is centered on the pivot rod and comprises outer sides that are spaced substantially away from the seat back vertical support members, the chair further including positioning means for maintaining the back cushion support in a centered position between the seat back vertical support members on the pivot rod.

3. The foldable chair according to claim 1 wherein the back cushion support comprises a pair of spaced elongated members attached to the back cushion at upper ends thereof and being interconnected by a cross member at lower ends thereof, the spaced elongated members being mounted on the pivot rod by aligned pivot rod holes through the spaced elongated members.

4. The foldable chair according to claim 3 wherein the upright holding means comprise mating fasteners attached respectively to the rear side of the seat and the cross members the fasteners being latchable and unlatchable by engaging and disengaging the fasteners.

5. A foldable seating structure containing a back support for supporting a person in a seating position comprising:

two seat front vertical support members each having a top that provides vertical support to the seating structure;

a seating support connected to the top of each of the two seat front vertical members;

two seat back vertical support members positioned respectively behind each of the two seat front vertical support members, extending above and connected to the seating support and providing vertical support to the seating structure;

a pivot rod connected to each of the two seat back vertical support members above the seating support;

a first back cushion support member mounted on the pivot rod for rotation about the pivot rod axis by means of a first pivot rod hold therethrough that fits over the pivot rod;

a second back cushion support member mounted on the pivot rod for rotation about the pivot rod axis by means of a second pivot rod hold therethrough that fits over the pivot rod;

a back cross member connected between lower ends of the first and the second back cushion supports at a position opposite the seating support;

upright holding means connected to the back cross member and the seating support for releasably holding the back support in a vertical position; and a back cushion connected to upper ends of the first and second back cushion supports for rearwardly supporting the person in the seating position.

6. The foldable seating structure according to claim 5 wherein the upright holding means is a multi-toothed resilient fastener configured to engage another similarly shaped multi-toothed resilient fastener.

7. The foldable seating structure according to claim 5 wherein the seat back vertical support members contain aligned blind holds positioned above the seating support and facing the interior of the foldable seating structure, with the opposite ends of the pivot rod being mounted in said holes.

8. The foldable seating structure according to claim 5 further including:

caster means connected respectively to the bottom of each of the seat front vertical support members and each of the seat back vertical support members for reducing the force required to move the foldable seating structure across a floor surface.

9. The foldable seating structure according to claim 5 further including:

spacer means connected around the pivot rod and positioned between the back cushion supports and their adjacent seat back vertical support members for centering the back support along the pivot rod.

10. The foldable seating structure according to claim 9 wherein the spacers are tubular sleeves.

11. The foldable seating structure according to claim 5 further including:

a seating support cushion resting on top of the seating support for providing a comfortable seating surface to the person seated in the seating position.

12. The foldable seating structure according to claim 11 wherein the back cross member extends below a level of the seating support cushion when the back support is held in the vertical position.

* * * * *

UNITED STATES PATENT AND TRADEMARK OFFICE

CERTIFICATE OF CORRECTION

PATENT NO. : 5,335,971

DATED : 08/09/94

INVENTOR(S) : James O. Kelley

It is certified that error appears in the above-identified patent and that said Letters Patent is hereby corrected as shown below:

In column 1, line 29, the word "station" should be -- stations --.

In column 4, line 28, in claim 4, the word "members" should be -- member, --.

In column 4, line 48, in claim 5, the word "hold" should be -- hole --.

In column 4, line 52, in claim 5, the word "hold" should be -- hole --.

In column 5, line 1, in claim 7, the word "holds" should be -- holes --.

In the Abstract, in line 15, the word "releasable" should be -- releasably --.

Signed and Sealed this

Thirteenth Day of December, 1994

Bruce Lehman

*Attest:*

BRUCE LEHMAN

*Attesting Officer*

*Commissioner of Patents and Trademarks*